United States Patent [19]

Lagain

[11] 4,062,271

[45] Dec. 13, 1977

[54] APPARATUS FOR STACKING BAGS

[76] Inventor: Georges Lagain, 65, rue du Moulin de Cage, 92230 Gennevilliers, France

[21] Appl. No.: 748,193

[22] Filed: Dec. 7, 1976

[30] Foreign Application Priority Data

Dec. 12, 1975 France ..... 75.38195

[51] Int. Cl.[2] ..... B31B 1/64

[52] U.S. Cl. ..... 93/33 H; 93/93 HT; 156/498

[58] Field of Search ..... 93/33 H, 93 HT, DIG. 1; 53/DIG. 2; 156/497, 498

[56] References Cited

U.S. PATENT DOCUMENTS

| | | | |
|---|---|---|---|
| 3,793,115 | 2/1974 | Jindra | 156/497 X |
| 3,810,420 | 5/1974 | Ravel | 93/93 HT |
| 3,813,998 | 6/1974 | Lotto | 93/33 H |
| 3,868,290 | 2/1975 | Lagain | 93/33 H X |
| 3,908,522 | 9/1975 | Bender | 93/33 H X |

*Primary Examiner*—James F. Coan

[57] ABSTRACT

Improvements in apparatus for stacking bags, particularly plastic bags, disposed at the outlet of a machine for manufacturing bags and comprising two sealing jaws of which at least one is mobile and of which the other has an edge extending downstream of said jaw and against which may abut a member for supporting the clamping of one of the ends of the bags after they have been cut in order to form a packet of bags assembled by sealing by means of a heating resistance disposed on the edge of the jaw. A means for sucking out the air and the hot gases is disposed opposite the support member 8 and beneath the edge 7 extending the sealing jaw 4. The invention finds application in a bag-making machine, for stacking the bags.

3 Claims, 2 Drawing Figures

APPARATUS FOR STACKING BAGS

The present invention relates to improvements in apparatus for stacking bags.

For manufacturing bags from a sheath or film of plastics material, machines are known in which the sheath or film, which is moved in translation, is cut and sealed at determined intervals. At the outlet of such machines, the bags are stacked in order to allow their assembling by sealing in the form of a packet of detachable bags.

To this end, it is known to use an apparatus for stacking bags, as described in U.S. Pat. No. 3,587,410, in which one of the ends of the pile of bags is clamped between an edge of the lower sealing jaw extending downstream thereof and a support member.

A retaining member cooperates with the support member to ensure clamping of the bags, when the support member is remote from the edge of the jaw for stacking a new bag.

For assembling the stack of bags in the form of a packet, the lower edge of the jaw is provided with an electrical heating resistance which seals the end of each bag on the stack which has already been assembled.

However, it has been noted that, with bags of small thickness, the end of the sack was repulsed, due to the production of hot gases at this level and of static electricity, and could not engage between the edge of the jaw and the support member in order to be stacked.

To remedy this drawback, an improvement has been made to the stacking apparatus according to the invention.

In accordance with the present invention, a means for sucking out the air and hot gases is disposed opposite the support member and beneath the edge extending the sealing jaw.

This disposition enables the end of the bag to be concealed and consequently results in an improved arrangement, in view of the extraction of the hot gases and mainly air at the seal of the packet of bags and in view of the attraction produced on the ends of the bags at the moment when they are folded on the stack of bags.

This device is particularly advantageous when the machine is used with an automatic removing device which removes packets of bags at determined intervals of time.

According to another feature of the invention, the device is completed by a supplementary de-electrifier disposed beneath the support member and whose action is added to that of the phenomenon of suction.

The invention will be more readily understood on reading the following description with reference to the accompanying drawings, in which.

Figure 1:
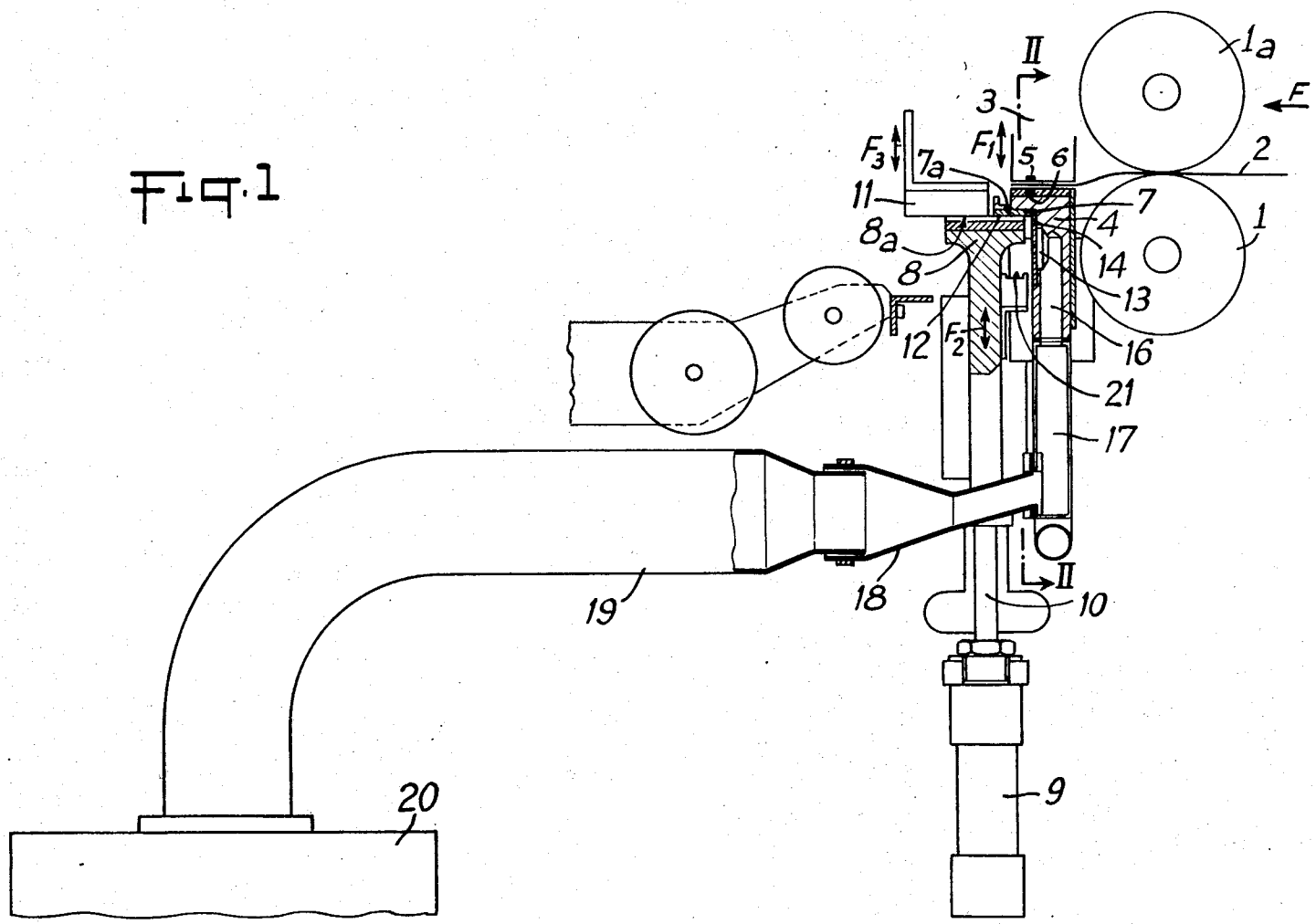
FIG. 1 shows a view in elevation and in transverse section of the improved bag stacking apparatus according to the invention.
Figure 2:
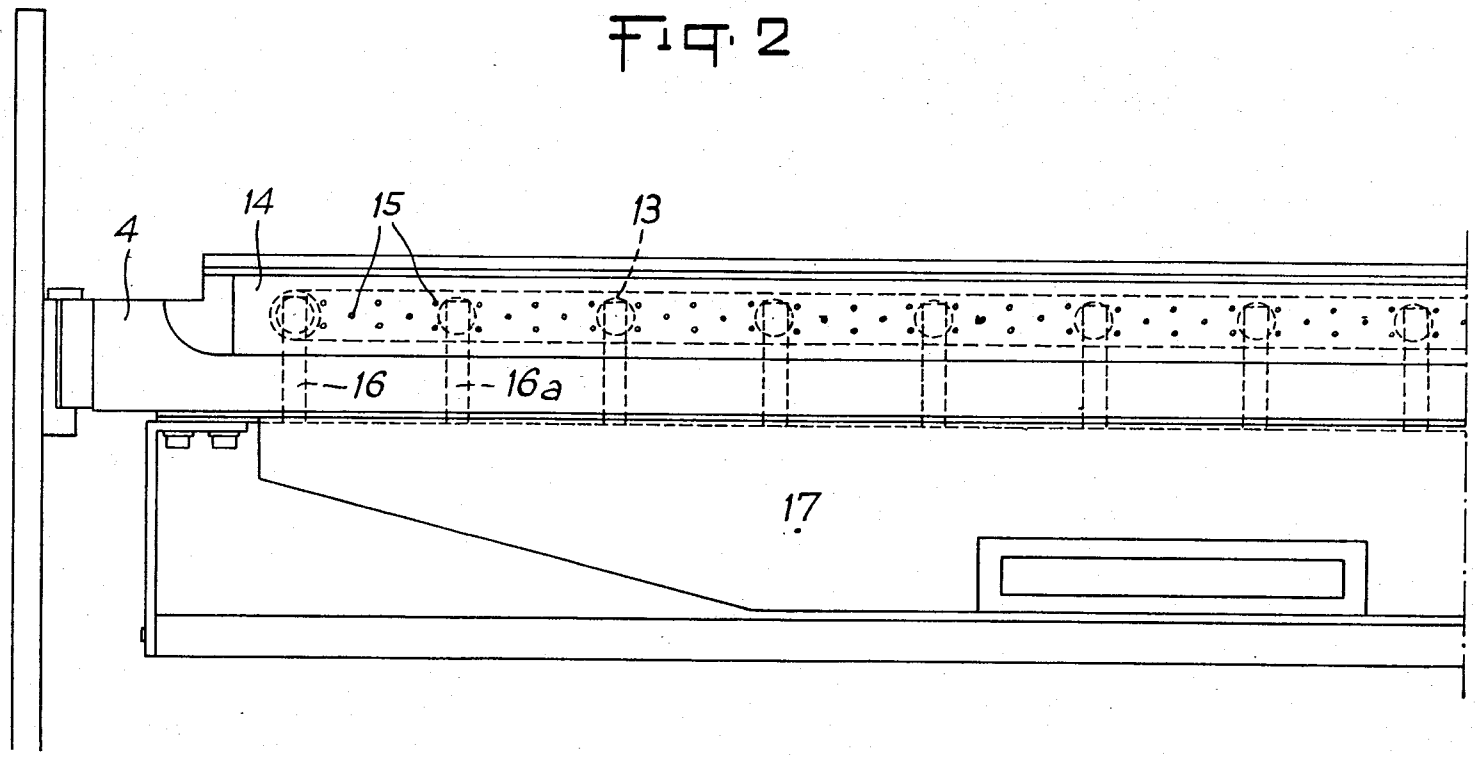
FIG. 2 is a view in elevation and in section along line II—II of FIG. 1.

Referring now to the drawings, FIGS. 1 and 2 show the outlet of a machine for manufacturing bags, comprising two rollers 1, 1*a* between which the sheath 2 made of plastics material is moved along in the direction of arrow F, two upper and lower sealing jaws 3 and 4 respectively, disposed on either side of the sheath and comprising an electrical resistance 5 and 6 respectively ensuring the heat-sealing of one of the sides of the sheath 2 in order to form the bottom of a bag.

The lower jaw 4 is fixed whilst the upper jaw may move in the direction of arrow $F_1$ to come into contact with the lower jaw 4 during the sealing operation of the sheath 2 which is clamped between the jaws. Futhermore, the upper jaw 3 is fast, in known manner, with a cutting member located downstream of the sealing resistance 5. The lower jaw 4 has an edge 7 extending downstream of said jaw and against which may abut a member 8 for supporting a pile of bags, mounted to slide in the direction of double arrow $F_2$ with respect to the lower jaw 4, said member being subjected to the action of a jack 9 to which it is connected by a rod 10.

Between the support face 8*a* of the support member 8 and the lower face 7*a* of the edge 7 of the lower jaw, the bags which are already stacked and which rest on the face 8*a* of the support member, are held by one of their ends. Downstream of the jaws 3 and 4, and above the support member 8 is slidably mounted a retaining member 11 which takes the form of a bar and which is driven by known mechanical means (not shown in the drawings), in the direction of arrow $F_3$ to come into contact with the bags disposed on the face 8*a* of the support member 8.

This device functions as described in U.S. Pat. No. 3,587,410.

On the lower face 7*a* of the edge 7 there is provided an electric heating resistance 12 constituting a member for sealing the ends of the bags stacked between the edge 7 and the support member 8, so as to constitute a packet of bags.

Beneath the edge 7 and opposite the support member 8, there is provided, in the lower extension of the jaw 4, a chamber 13 extending longitudinally over the major part of the length of the jaw, said chamber 13 being closed on the side opening opposite the support member 8 by a grid constituted by a plate 14 fixed on the jaw and having openings 15 distributed over the whole length of the chamber 13. The chamber 13 is connected by pipes 16, 16*a*.. distributed over the whole of its length to a suction hood 17 fixed to the lower part of the jaw 4 and connected by a rigid conduit 18 and a flexible pipe 19 to a suction fan unit 20.

When the bag stacking device operates, the suction fan unit 20 is switched on so that the air and hot gases located at the level of the support member 8 and beneath edge 7 are sucked through the openings 15 in the chamber 13 and through conduits 16, 16*a* in the hood 17 and through conduit 18 and pipe 19 through the fan 20 to the outside.

This arrangement allows the end of the bags to be concealed during their stacking, apart from the evacuation of the gases and hor air.

On the support member 8 is fixed a de-electrifier 21 located under the support face 8*a* of said member. The action of the de-electrifier 21 is added to that of the above-described phenomenon of suction, in order to facilitate concealment of the bags.

What is claimed is:

1. In an apparatus for stacking plastic bags disposed at the outlet of a machine for manufacturing bags including two sealing jaws with at least one of said jaws being mobile; at least one of said jaws having an edge attached thereto and extending downstream therefrom, for a support member having a support face abutting against said edge for supporting a stack of said bags and clamping one of the ends of the bags after they have been cut, a heating resistance disposed on said jaw edge to heat seal said stack to form a packet of said bags, a retaining member disposed downstream of said jaws and movable parallel thereto in cooperation with said support member the improvement comprising providing a fluid suction means in the lower part of the sealing jaw over at least a part of the length of said jaw, said suction means located beneath said support edge and opposite said support member.

2. Improvements as defined in claim 1, wherein a de-electrifier is disposed beneath the support member.

3. Improvements as defined in claim 1, wherein the chamber is connected via conduits to a suction hood having in its lower part an opening connected to a suction-fan unit.

* * * * *